US009186032B2

(12) United States Patent
De Wit et al.

(10) Patent No.: US 9,186,032 B2
(45) Date of Patent: Nov. 17, 2015

(54) CLEANING DEVICE AND VACUUM CLEANER

(75) Inventors: Bastiaan Johannes De Wit, Nuis (NL); Fokke Roelof Voorhorst, Drachten (NL); Johannes Tseard Van Der Kooi, Hurdegaryp (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 622 days.

(21) Appl. No.: 13/520,365

(22) PCT Filed: Jul. 29, 2010

(86) PCT No.: PCT/IB2010/053452
§ 371 (c)(1),
(2), (4) Date: Jul. 31, 2012

(87) PCT Pub. No.: WO2011/083373
PCT Pub. Date: Jul. 14, 2011

(65) Prior Publication Data

US 2012/0284950 A1 Nov. 15, 2012

(30) Foreign Application Priority Data

Jan. 7, 2010 (EP) ..... 10150263

(51) Int. Cl.
*A47L 11/34* (2006.01)
*A47L 11/40* (2006.01)

(52) U.S. Cl.
CPC ..... *A47L 11/34* (2013.01); *A47L 11/4041* (2013.01)

(58) Field of Classification Search
CPC ..... A47L 11/34; A47L 11/4041
USPC ..... 15/320, 322
IPC ..... A47L 11/34
See application file for complete search history.

(56) References Cited

U.S. PATENT DOCUMENTS

| | | | |
|---|---|---|---|
| 6,588,050 | B1 | 7/2003 | Aiken |
| 6,662,402 | B2 | 12/2003 | Giddings |
| 6,681,442 | B2 | 1/2004 | Tondra et al. |
| 6,905,537 | B1 | 6/2005 | Isaacs |
| 7,377,009 | B2 | 5/2008 | Lee et al. |
| 7,665,174 | B2 | 2/2010 | Basham |
| 2003/0159232 | A1 | 8/2003 | Hekman |
| 2006/0236494 | A1 | 10/2006 | Nelson et al. |
| 2010/0050368 | A1 | 3/2010 | Curien |

FOREIGN PATENT DOCUMENTS

| | | | |
|---|---|---|---|
| EP | 1654974 | A1 | 5/2006 |
| FR | 2909275 | A1 | 6/2008 |
| GB | 519762 | A | 11/1938 |
| GB | 2365323 | A | 2/2002 |
| GB | 2416113 | A | 1/2006 |
| JP | 2004147759 | A | 5/2004 |
| JP | 2005027807 | A | 2/2005 |
| WO | 8701266 | A1 | 3/1987 |

*Primary Examiner* — David Redding

(57) ABSTRACT

The invention relates to a cleaning device (1) for removing particles from a surface (11). Thereto the device sprays droplets (200) of a fluid (201) into a space (213). The droplets (200) are expelled from a rotatable brush (3) as a mist of droplets. Air carrying dirt particles (202) is exposed to the mist, whereby dirt particles coalesce with droplets in the mist in the space (213). The coalesced particles (22) are conveyed to a cleansing unit (14) to be separated from the air. Finally, clean air exits from the device (1).

15 Claims, 6 Drawing Sheets

CLEANING DEVICE AND VACUUM CLEANER

FIELD OF THE INVENTION

The invention relates to a cleaning device for removing particles from a surface, comprising spraying means for spraying droplets of a work fluid, a rotatable brush, an inlet for receiving dirtied air such as air laden with particles, and a cleansing unit. The invention also relates to a vacuum cleaner.

BACKGROUND OF THE INVENTION

Such a cleaning device is known from U.S. Pat. No. 7,377,009. U.S. Pat. No. 7,377,009 discloses a complex type cleaner implementing both a vacuum cleaning function for sucking dust and a water cleaning function. The cleaner has a cleaner body including a container mounting part. In the container mounting part either a dust collecting container for storing dust or a water collecting container for storing contaminated water can be selectively mounted. The water collecting container includes a container mounted at the container mounting part and having a space for storing contaminant water, a suction pipe connected to the side of the container, extended in a downward direction of the container, and connected to a water suction hose. A discharge passage is formed at the lower side of the container and discharges air from the container. A water discharge preventing unit is mounted at the discharge passage and prevents contaminated water introduced into the container from being leaked outside through the discharge passage. The cleaner has a suction head with a dust suction opening sucking dust when the cleaner performs a vacuum cleaning and a suction head with a nozzle for sucking contaminated water when the cleaner performs cleaning in a water cleaning mode of the cleaner. The suction nozzle is mounted at the front side of the suction head with the dust suction opening in order to suck contaminated water which has cleaned the carpet or the floor after being sprayed from a washing water spraying unit in the water cleaning mode of the cleaner. A brush is rotatably mounted in the dust suction opening. When the cleaner is in a vacuum cleaning mode, dust or foreign materials on the floor are brushed up to an inner side of the dust suction opening. In case of the water cleaning mode the brush rubs on the carpet where washing water has been supplied from the washing water spraying unit to wash the carpet. The washing fluid gets contaminated by the dust and dirt particles on the surface. After the washing operation, the contaminated fluid is being removed from the surface by suction force generated by a vacuum fan and is collected in the water collecting container. By the known cleaning device a relatively large amount of washing water needs to be applied to the surface to ensure that all dust particles become wet. If relatively small particles do not become wet, these small particles might still be transported by the air to the water collecting container. However, it is relatively difficult to separate such small dry particles from the air by means of the water discharge preventing unit. For small particles it is even more important to be removed from the surface and to be separated from the exhaust air because of the risk of health problems. A disadvantage is that the cleaning device needs to be moved twice over the surface, a first time to perform a washing operation and a second time to remove the contaminated fluid from the surface. Another disadvantage of using large amounts of water is that the debris collecting container needs to be emptied relatively often.

SUMMARY OF THE INVENTION

It is an object of the invention to provide a cleaning device whereby relatively small particles can easily be wetted by a relatively small amount of fluid.

This object is achieved by the cleaning device according to the invention by a cleansing unit suitable for separating at least a portion of the droplets of work fluid from the air, wherein the spraying means comprises the rotatable brush provided with flexible brush elements, which rotatable brush is in use wettable by the work fluid, whilst the brush is rotatable at such a rotational speed and is of such a dimension that in use the droplets of the work fluid are being expelled as a mist of droplets from the flexible brush elements into a coalescing space of the device, the dirtied air received by the inlet being receivable by the coalescing space, to form coalesced particles of the droplets expelled from the brush elements and particles in the dirtied air, the coalesced particles being conveyable from the coalescing space to the cleansing unit for separating at least a portion of the coalesced particles from the air.

During rotation of the brush, acceleration forces such as centrifugal forces will among others be exerted on the brush and the flexible brush elements. On top of the centrifugal forces other acceleration forces may be present such as acceleration forces due to deformation of the flexible brush elements. Such a deformation is present for example if the brush is in contact with the surface to be cleaned. In such a case the flexible brush elements are straightened when they are not in contact with the surface and they will be bent when they get in contact with the surface. This process of deformation from a straightened to a bent configuration and vice versa will result to additional accelerations of the flexible brush elements and portions thereof. The rotatable brush and the flexible brush elements are wettable by the work fluid, e.g. when in contact with the floor or surface to be cleaned the brush hairs pick up a work fluid such as water or a mixture of water and soap. Alternatively the work fluid may be provided to the flexible brush elements by guiding the work fluid directly to the flexible brush element, e.g. by oozing the fluid onto the brush or by injecting of the fluid into a hollow core of the brush. In such a case it is not necessary that the brush is arranged to contact the surface to be cleaned. Instead of addition of an intentionally chosen work fluid it is also possible to use a spilled fluid—already present at the surface to be cleaned—as a work fluid, such as spilled coffee, milk, tea or the like. The work fluid held by the flexible brush elements is expelled there from due to the acceleration forces. These acceleration forces are influenced by dimension and rotational speed of the brush; however, as explained above, also deformation of the flexible brush elements may also have impact on the acceleration. At low accelerations almost no work fluid may be expelled while at increasing accelerations some splashing or spattering may occur. At even higher rotational speeds and corresponding accelerations droplets are formed and from certain acceleration onwards droplets of the work fluid are being expelled as a mist of droplets from the flexible brush elements. The mist of droplets is expelled into the coalescing space. The mist of droplets intermingles with air present in the coalescing space and thus forms a mist of airborne droplets of working fluid.

The coalescing space receives dirtied air from the inlet. In the dirtied air dirt particles are present. The dirt particles may be of a solid and/or of a liquid nature and will generally be of varying size, shape and weight. Specifically the small particles may impose a health risk and therefore should be captured as much as possible. As the coalescing space is holding the airborne droplets of working fluid as well as the dirt particles and notably the small particles, collisions between droplets of work fluid and the dirt particles will occur. Due to the collisions, the droplets will fuse with the particles, whereby coalesced particles are formed which in general are larger and heavier than the dust particles before collision with the droplets. The coalesced particles are conveyed to the cleansing unit where they are separated from the air in which they are airborne. Since these coalesced particles are relatively large and heavy compared to the dirt particles contained therein they can more easily be separated from the air by the cleansing unit. Likewise these coalesced particles are larger and heavier than the droplets of work fluid from which they originate, i.e. before coalescence with the dirt particle(s). The coalesced particles originate from droplets of work fluid. These droplets of work fluid are of such a size and weight that at least a portion thereof is separable by the separating unit. For this reason the coalesced particles which are built from such separable droplets of work fluid will also be separable. For example, a dirt particle which is in the HEPA range, for example having a diameter which is less than 1 micrometer, may be separated by virtue of the coalescence in a separating unit which is not suitable for separating a particle of such small dimensions had it not been fused or coalesced with a droplet of work fluid.

The separating unit may for example comprise a filter or a centrifugal fan. In general, particles are more easily separated as their weight and size increases. Hence, the specific species of the separating unit, does not limit the applicability of this invention.

A mist of droplets of work fluid is generated to catch the dirt particles. The mist of droplets is of a lower average density and contains less working fluid than for example a puddle of fluid which contains the dirt particles drifting around in it. Hence, according to the invention, a relatively moderate quantity of working fluid is required.

In case of water cleaning via a puddle of fluid and dirt particles contained therein, which is sucked up by a suction nozzle, only the particles in the direct vicinity and specifically under the nozzle enter the nozzle and will be removed. Since the cleaning device according the invention has an inlet into which dirtied air can be received, it is also possible to remove dirt particles which are not floating in a puddle of fluid but which are carried along in airstreams that enter the inlet. In fact, it is known that a significant part of particles originates not from directly underneath the inlet but also near and around the inlet. Due to the inlet according to the invention, the working area from which dirt particles are effectively removed is considerably enlarged.

In an advantageous embodiment of the cleaning device according to the invention the brush is of such a dimension and is rotatable at such a rotational speed that in use droplets of work fluid are being expelled from the brush elements due to an acceleration of the tips of the flexible brush elements of at least 3000, more preferably of at least 6000 m/sec$^2$.

The coalescing effect is typically allied to soft brushes, i.e. with flexible brush elements, which are driven at high rotational speeds. As stated before the acceleration may result from mere rotation or from a complex deformation pattern of the elements on top of rotation. Such a complex pattern may result for example if the brush elements contact the floor or if they contact another elements of the cleaning device such as a spoiler. Independent of the cause of the acceleration, i.e. mere rotation or a combination of rotation and deformation, the coalescing process becomes efficient at an acceleration of at least 3000 m/sec$^2$, but it becomes very efficient at an acceleration of at least 6000 m/sec$^2$. At such acceleration, it is achieved that the droplets are being expelled at a size large enough to be able to coalesce with the particles at the same time making them more easily separable, yet small enough to create a mist with an enormous amount of droplets guaranteeing a high likelihood of coalescence between droplets and dirt particles. The acceleration at the circumference of the brush in case of mere rotation can be determined by a person skilled in the art in a straightforward manner since such acceleration depends on the diameter D of the brush and the angular velocity $\omega$ of the brush ($a=0.5*D*\omega^2$). In case of a complex pattern use can be made of high speed cameras, to track the path of the brush element tips in an experimental way.

In a very advantageous embodiment of the cleaning device according to the invention at least a portion of the flexible brush elements of the rotatable brush is, during use, in contact with the surface to be cleaned.

On top of the functionality of providing a mist of droplets the brushes act on the surface to be cleaned which is advantageous for the removal of dirt which sticks to said surface. An extra advantage of such an arrangement is that fluid which is already present on the floor and which has to be removed there from can be used as working fluid out of which the coalescing coreels are to be formed.

An advantageous embodiment of the cleaning device according to the invention comprises at least two brushes each of the at least two brushes expelling during use a mist of droplets in a direction towards a common target region of the coalescing space, which target region is accessible to a at least portion of the dirtied air.

By thus directing more mist sprays of working droplets into one and the same target region, the dirtied air is bombarded with droplets whereby the chance of a catch of a dirt particle is significantly improved. Furthermore, the coalescing effect is concentrated in this region and this contributes to the compactness of the device while at the same time preserving the effectiveness of the coalescence.

An advantageous embodiment of the cleaning device according the invention comprises at least two brushes, each of the at least two brushes having a portion of flexible brush elements which is in contact, during use, with the surface to be cleaned, the at least two brushes being rotatable in opposite directions directed towards each other at the surface to be cleaned.

In such an arrangement the inlet and the coalescing chamber coincide in a cost efficient way. The expelled droplets are concentrated in a region between the brushes and the brushes delimit the inlet and the coalescing space. Hence, the coalescing process can be carried out very effectively with relatively little construction strain.

In an advantageous embodiment of the cleaning device according to the invention the rotatable brush is rotatable at least at 3500 revolutions per minute, preferably at least at 7000 revolutions per minute, and more preferably at least at 8000 revolutions per minute.

These rotational speeds result to a relatively large amount of droplets of the working fluid which have sizes that are suitable for separation in commonly used cleansing units via centrifugal fans or filters. Preferred diameters for the rotating brushes are between 40 and 80 mm. In this preferred diameter range of the brushes these rotational speeds are feasible with commonly used drive units for consumer appliances.

In an advantageous embodiment of the cleaning device according to the invention the rotatable brush has during use a diameter of at least 20 mm.

At smaller diameters of the brush the rotational speed which is required to reach the minimum acceleration becomes too high, leading to excessive demands for driving the brushes and to bearing losses. The length of the flexible brush elements becomes too short to absorb irregularities in the surface to be cleaned.

In an advantageous embodiment of the cleaning device according to the invention the average distance between two adjacent flexible brush elements is between 10 and 100, more preferably between 20 and 40 micron.

With such a distance small droplets of the cleansing fluid can be formed and be held between the brush elements, for example by capillary forces.

In an advantageous embodiment of the cleaning device according to the invention the brush elements have a Dtex-value of between 0.01 and 50, preferably between 0.1 and 10 and even more preferably between 0.1 and 2

Such thin brush elements do not have enough stiffness to maintain a straight position itself and will only be straightened by the acceleration forces. When the brush is rotated at high speed, the brush elements will impact with the surface and will release their energy at the same time. The thin brush elements will hardly exert any normal force to the surface so that hardly any friction force will occur between the brush elements and the surface. Since nearly no friction occurs, damage or wear to the brush elements and surface is limited. Furthermore, brush elements with a relatively low Dtex value have a relatively high wear resistance, which ensures a long lifetime. Although some materials have better wear-resistance and/or are more expensive than others, the brush elements may comprise materials like cotton, linen, wool, silk, viscose, acetate/triacetate (CA/CT), polyamide (PA 6/PA 66), polyamide (PA 11), Polyester/Polyethylene terephthalate (PES/PET), Polyester/Polybutylene terephtalate (PES/PBT), meta-Aramid (m-AR), para-Aramid (p-Ar), Elastane/Polyurethane (EL/PUR), Polyacrylonitrile (PAN), Modacrylic (MAC), PolyPropylene (PP), Polyethylene (PE), PolyVinylchloride (PVC), Polyvilylalcohol (PVAL), Fluorofiber (PTFE), Carbon Fiber (CF).

In an advantageous embodiment of the cleaning device according to the invention the brush elements comprise polyester and have a Dtex-value of between 0.01 and 50, preferably between 0.1 and 10 and even more preferably between 0.1 and 2

Such a light brush elements do not have enough stiffness to maintain a straight position itself and will only be straightened by the acceleration forces. When the brush is rotated at high speed, the brush elements will impact with the surface and will release their energy at the same time. The thin brush elements will hardly exert any normal force to the surface so that hardly any friction force will occur between the brush elements and the surface. Since nearly no friction occurs, damage or wear to the brush elements and surface is limited. Furthermore, brush elements with a relatively low Dtex value have a relatively high wear resistance, which ensures a long lifetime.

In an advantageous embodiment of the cleaning device according to the invention the tufts density is at least 30 tufts (17) per cm2.

Due to the large number of brush elements a relatively large amount of working fluid can be picked up per $cm^2$, whereby a relatively dense spray is generated.

BRIEF DESCRIPTION OF THE DRAWINGS

The invention will be explained in more detail with reference to the drawings, in which.

Like Parts are Indicated by the Same Reference Numbers in the Figures.

DETAILED DESCRIPTION OF EMBODIMENTS

Figure 8:
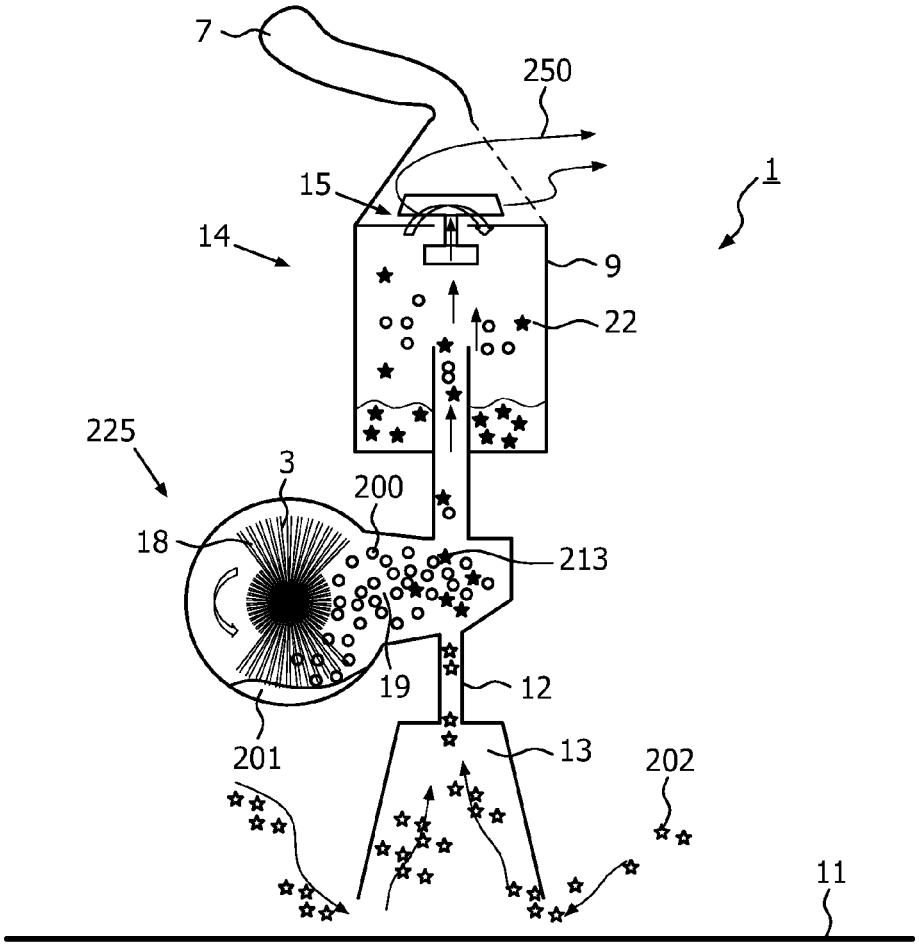
FIG. 8 is a schematic cross section of a cleaning device according to the invention.

Next some working principles of the invention will be explained with reference to FIG. 8. In FIG. 8 a cross section of a cleaning device according to the invention is schematically depicted. The cleaning device 1 has an inlet 13 is positioned above a surface 11 to be cleaned. Particles 10 or 202 are sticking to or floating above the surface 11. The device sucks these particles 202 and the air in which they are airborne up into the inlet 13. Means to cause such an airstream, e.g. by a vacuum, are known to the skilled person and will not be described here. The device 1 has spraying means 225. The spraying means comprise a rotatable brush 3. As the brush is rotated a work fluid 201 will wet the brush hairs 3 and droplets of the work fluid 201 will be expelled from the flexible brush hairs or elements 18. Depending on the rotational speed and the dimension of the brush 3 the constitution of the expelled droplets may be altered. From a certain rotational speed onwards, the droplets are expelled as a mist 19 of droplets into a coalescing space or chamber 213 of the device 1. The air which is received by the inlet 13 is dirtied with particles 202. Via a flow channel 12 the dirtied air is transported to the coalescing space 213 and subsequently conveyed through the coalescing space 213. In the coalescing space 213 the dirtied air intermingles with the mist 19 generated by the spraying means 225. A portion of the droplets 200 will hit a portion of the particles 202 and get attached thereto to form coalesced particles 22. The size and weight of the coalesced particles 22 are a result of the coalescence of at least one dust particle 10 or 202 and at least one droplet 200; hence, the size and weight of the coalesced particles are larger than the size and weight of the particles 202 and droplets 200 from which they are made up. Due to the large amount of droplets 200 a large amount or even all dust particles 10 or 202 will coalesce with a droplet 200. The coalesced particles 22 are subsequently conveyed via a further flow channel similar to channel 12, the further flow channel being between the coalescing space 213 and a debris collecting container 9, to a cleansing unit having a vacuum or centrifugal fan aggregate 15. The debris collecting container 9 collects most of the coalesced particles 22. The bigger and heavier particles 22 generally fall down towards the bottom of the debris collecting container 9. The smaller coalesced particles 22 proceed towards the centrifugal fan 15 where they will be separated from the air. The centrifugal fan aggregate 15 comprises two fan assemblies. A vacuum fan assembly and a separation fan assembly. While the vacuum fan assembly causes the air stream through the device, the separation fan assembly is positioned inside container 9 and causes the particles 22 to be centrifuged out of the air. The centrifugal fan assembly and the vacuum fan assembly work counterproductive in relation to the airstream through the device. After disposal of coalesced particles 22, relatively clean air 250 leaves the device 1 via a grid near and directed away from a grip or handle 7 of the device so that a user who manoeuvres the device via the handle 7 across the surface 11 is not bothered by the airstream 250 leaving the device 1.

Figure 1:
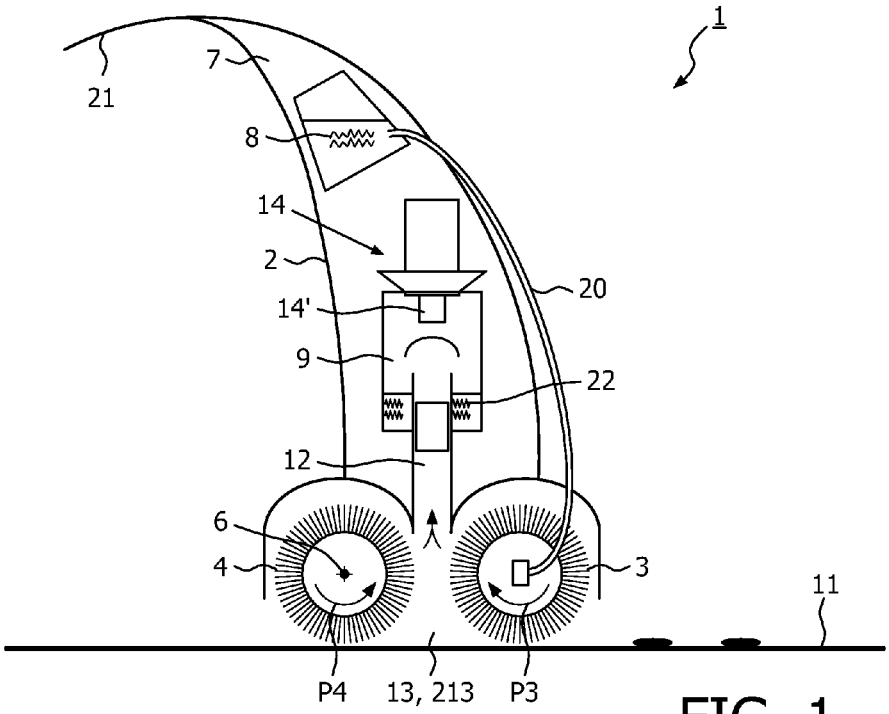
FIG. 1 is a schematic cross section of a cleaning device according to the invention.
Figure 2:
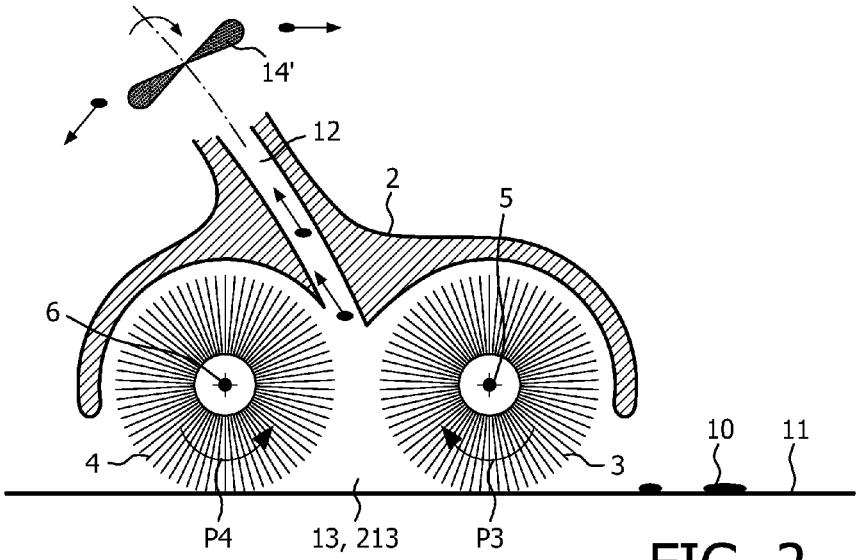
FIG. 2 is an enlarged cross section of a part of the perspective view of the cleaning device as shown in FIG. 1.
Figure 3:
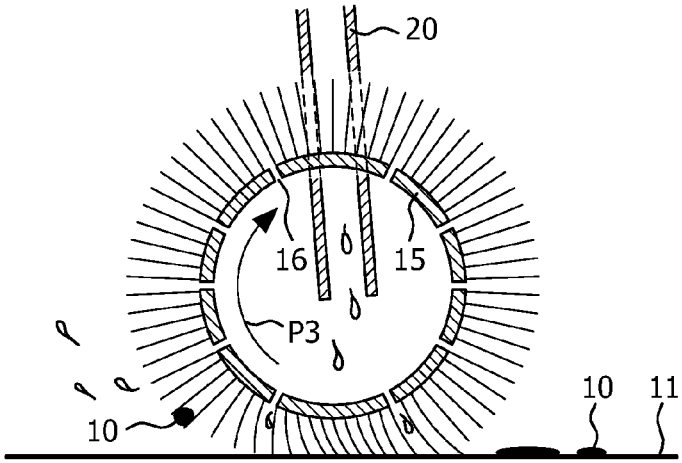
FIG. 3 is a cross section of a brush of the cleaning device as shown in FIG. 1.

FIG. 1-7 show different views of a cleaning device 1 according to the invention. The cleaning device 1 comprises a housing 2 in which two brushes 3, 4 are rotatably mounted around axles 5, 6. The brushes 3, 4 are driven by a motor (not shown). The motor might be located on any suitable position whereby via gears or belts the brushes 3, 4 are being rotated with a speed of 3000-10,000 revolutions per minute. The axle of the motor can also be directly connected to the axle of the brush, whereby the motor can be placed inside the brush, for example. The diameter of the brushes may for example be between 40 and 80 mm. The length of the brush may for example be about 25 cm. As shown in FIG. 1-3, the brush 3 is rotatable in a clockwise direction, indicated by arrow P3 and the brush 4 is rotatable in a counter clockwise direction, indicated by arrow P4 around the respective horizontal axles 5, 6. The brushes 3, 4 are fully enclosed except at the bottom by the housing 2. The housing 2 is provided with wheels (not shown) keeping the axles 5, 6 at a predetermined distance of the surface to be cleaned. The housing 2 is provided with a handle 7 at a side remote of the brushes 3, 4. Between the handle 7 and the brushes 3, 4 the cleaning device 1 is provided with a reservoir 8 for a cleansing fluid like water and a debris collecting container 9 for fluid and particles 10 picked up from the surface 11 to be cleaned. The debris collecting container 9 is provided with a flow channel in the form of for example a hollow tube 12 extending from an opening 13 between the brushes 3, 4 into the debris collecting container 9. At a side of the debris collecting container 9 opposite the tube 12 the debris collecting container 9 is provided with a vacuum fan aggregate 14 and cleansing unit comprising a centrifugal fan 14' as rotatable separator. By the arrangement of the rotating brushes the inlet 13 is a space which is confined by the surface to be cleaned 11 and the brushes 3, 4. The coalescing space 213 and the inlet 13 converge in this arrangement. As can clearly be seen in FIGS. 2 and 3, the brushes 3, 4 comprise a hollow core 15 in the form of a tube provided with a number of channels 16 extending through the wall of the core 15. On the outside of the tube 15 tufts 17 are provided. Each tuft 17 is made up of hundreds of individual fibres being brush elements 18. The brush elements 18 are made of polyester with a diameter of about 10 micron, with a Dtex in the range between 0.01 and 50 and having a tuft density of at least 30 tufts per $cm^2$, for example.

Figure 4:
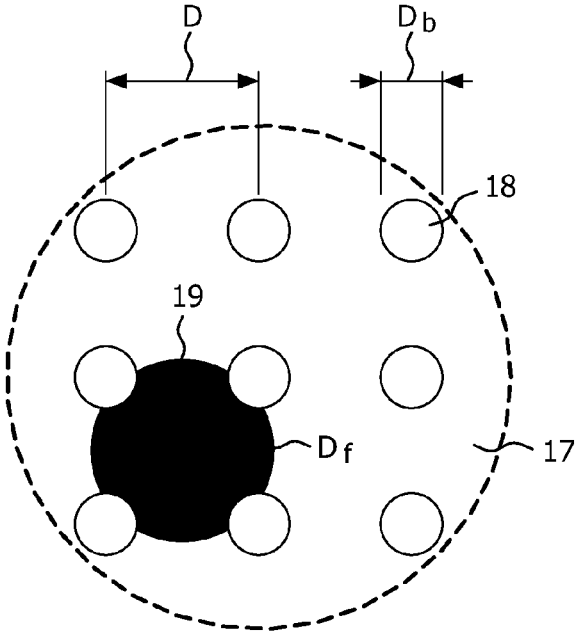
FIG. 4 is a cross section of a tuft comprising a number of brush elements.
Figure 5:
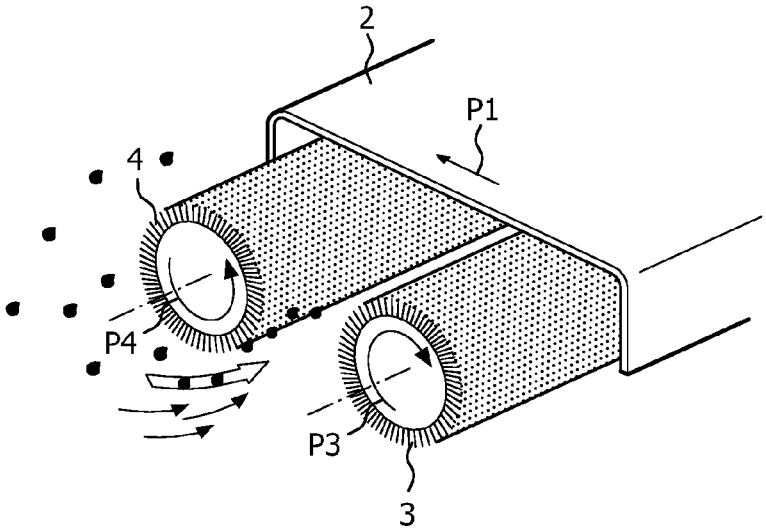
FIG. 5 is a perspective view of two brushes of the cleaning device as shown in FIG. 1.
Figure 6:
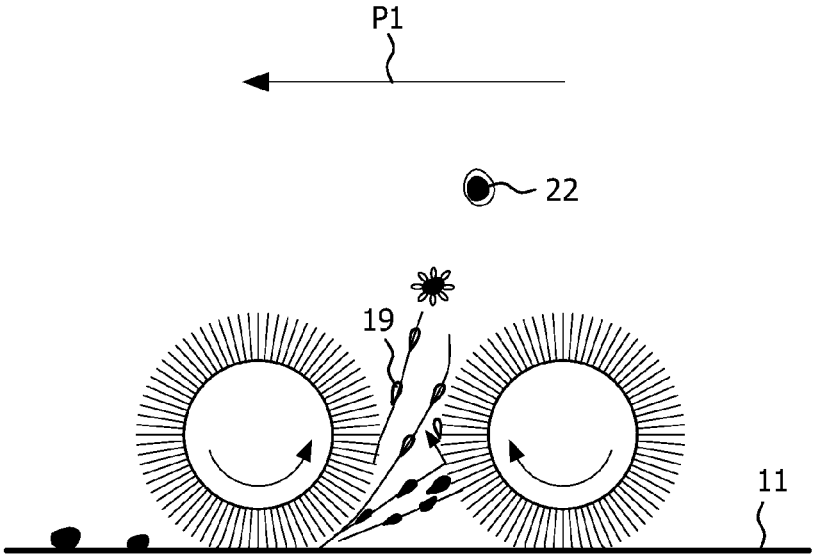
FIG. 6 is a schematic cross section of two brushes of the cleaning device as shown in FIG. 1, with dust particles, droplets of fluid and coalesced particles.
Figure 7:
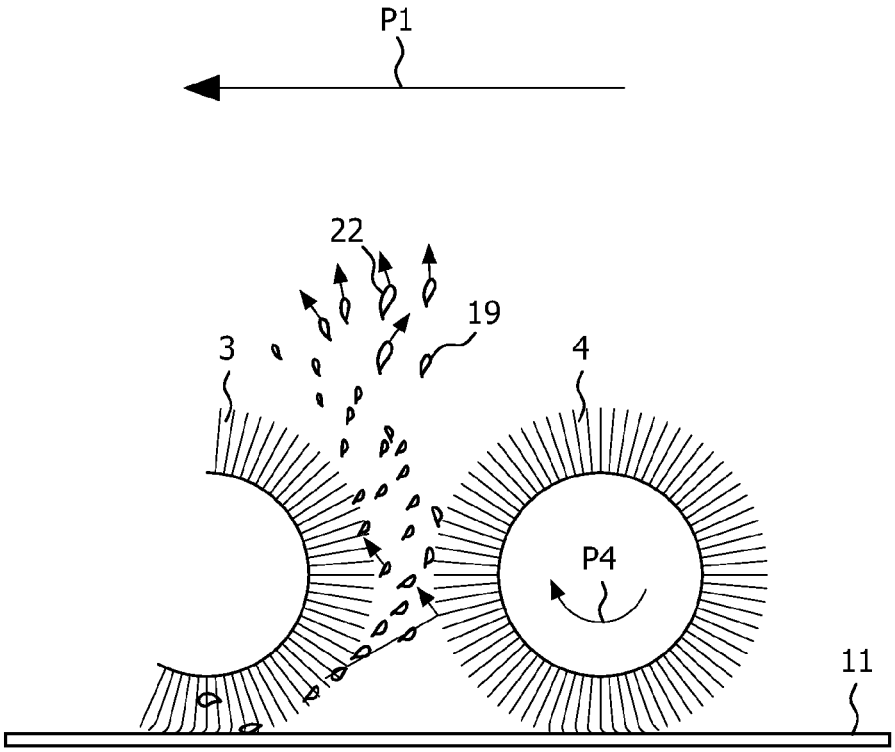
FIG. 7 is an enlarged view of FIG. 5.

FIG. 4 shows a cross section of a tuft 17 with brush elements 18. Only nine brush elements 18 are shown in FIG. 4. The diameter $D_b$ of the brush element 18 is about 10 micron. The average distance D between two adjacent brush elements 18 is about 28 micron. Here it should be mentioned that in general the brush elements may be rather chaotically arranged. Between the brush elements 18 droplets 19 of fluid can be formed. These droplets have a considerable spread in diameter. This may among others be due to the rather chaotic arrangement of the brush elements 18 inside a tuft. The droplet size or diameter is among others determined by capillary action between brush elements 18. Droplets which are very small, i.e. in the order of magnitude of 1 micron will vanish or explode very quick because of a high surface tension which results from a large ratio between surface and volume of the droplets. These very small droplets may not even participate in the coalescing process. The droplet size may be adjusted with the rotational speed of the brush. It should be attuned to the characteristics of cleansing unit, i.e. the smallest coalesced droplets which reach the cleansing unit are the hardest to separate.

From the reservoir 8 (see FIG. 1) for work fluid a flexible tube 20 extends. An end of the flexible tube 20 ends inside the hollow core 15 of the brush 3 or 4 via a side of the brush 3 or 4, respectively. The reservoir 8 and the tube 20 together with the brushes 3, 4 form spraying means.

While work fluid may leave the hollow brush via openings 16 and is transported by channels formed between the brush elements to the outside of the brush, another part of the work fluid may first leave the hollow core of the brush as relatively large droplets that drizzle or fall on the surface to be cleaned or floor 11. The floor 11 thus becomes wet with work fluid. Subsequently the work fluid which is drizzled to the floor is fed into the brush again by capillary action caused by the brush elements which together may form capillary channels when the brush elements are in contact with the floor. After coming loose from the floor the work fluid is expelled from between the brush elements as a mist of droplets of work fluid by the acceleration of the tips of the brush elements caused by the centrifugal forces and deformation of the elements.

A power cord 21 enters the handle 7 and is guided through the housing 2 to motors for rotating the brushes 3, 4, to a device for feeding cleansing fluid from the reservoir 8 to the brush 3, and to the vacuum fan aggregate 14 and centrifugal fan 14'. The function of feeding may in another embodiment be provided by gravity, i.e. the fluid flow is driven by gravity.

In use, the cleaning device 1 is being moved in a direction as indicated by arrow P1 over the surface to be cleaned 11. During said movement, the brushes 3, 4 are being rotated in opposite directions P3, P4 at angular velocities ω (rad/sec). The directions P3, P4 are directed towards each other near the surface to be cleaned 11. Cleansing fluid is inserted inside the tube 15 of the brush 3 or 4. Due to acceleration forces, work fluid flows through the channels 16 and is subsequently transported through and between the tufts 17 onto the surface 11. The brush elements 18 of the tufts 17 on the brushes 3, 4 are being moved over the surface to be cleaned 11 and the dirt and other materials are being disconnected from the surface 11. Simultaneously, the surface is being cleaned by the work fluid by solving and soaking of dirt into said fluid. By further moving the cleaning device 1 in the direction as indicated by arrow P1, the disconnected particles 10 and the cleansing or work fluid on the surface are being moved upwards into the inlet 13 due to the rotational movement of the brushes 3, 4.

When the brush 3, 4 having a diameter of 44 mm, is rotated at 8000 revolutions per minute, the centripetal acceleration due to the rotational speed and imposed on the tips of the brush elements can be calculated as $$a=0.5*D_{brush}*\omega^2=0.5*0.044*(2*\pi*8000/60)^2=15424 \text{ m/sec}^2.$$

If the brush does not make contact with the floor 11 this may be a good approximation of the actual acceleration of the tips of the brush elements. However, if the brush tips run into a contact surface the brush elements are deformed near the contact surface and are straightened back again to their original form when the contact is lost. This straightening is a very fast deformation process because the flexible brush elements are very thin and have almost no resistance against bending. So, at the loss of contact between the brush elements and the contact surface or floor, the brush elements rapidly change their form from a bent state or configuration to a straight one.

This results to a whip like motion of the tips of the brush elements which gives an extra acceleration of the tips on top of the acceleration due to the rotation of the brush. The acceleration forces will overcome the capillary forces between the droplets and the brush elements 18.

With such acceleration forces, in combination with a large amount of tufts the work fluid is divided into a large amount of small droplets 19. The size of the droplets 19 is preferably between 10 and 100 microns and more preferably between 28 and 57 microns, i.e. well attuned with state of the art cleansing unit specifications. The droplets 19 will hit the particles 10 and get attached thereto according to the technical effects and principles as already described in reference to FIG. 8.

Figure 9:
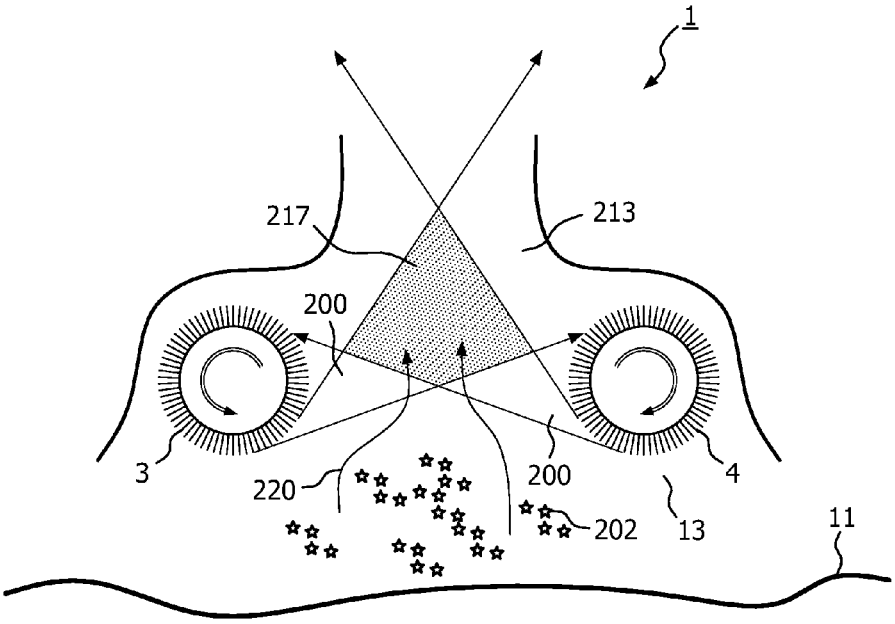
FIG. 9 is a schematic cross section of a cleaning device according to the invention.

In FIG. 9 a cross-section of an embodiment of a cleaning device 1 according to the invention is schematically depicted. An inlet 13 receives dirtied air indicated by arrows 220. Dirt particles 202 are carried along in the dirtied air 220. A first brush 3 or 4, rotating anticlockwise, expels a mist 200 of droplets of work fluid into a coalescing space 213. A second brush 4 or 3, rotating in a clockwise direction, also expels a mist of droplets of work fluid. The two mists are directed towards and cover a common target region 217 in the coalescing space 213. In the region 213 the droplet density of the mist in considerably increased compared to a situation with only one brush or with more brushes without overlap of the generated mist. Furthermore, droplets expelled by brush 3 may hit droplets expelled by brush 4 as there velocities are oppositely directed due the rotational directions of the brushes 3 and 4. This leads to coalescence between droplets of brush 3 and 4. Specifically for small droplets, which may form a problem in the cleansing unit (not shown) this is advantageous, because these small droplets may coalesce with droplets from the opposite brush to form bigger and heavier particles which do not form a problem to get separated from the air in the cleansing unit. The dirtied air is conveyed towards the common target region 217 and after accessing the region 217 and the airborne dirt particles form targets to be shot at by the work fluid droplets. From the figure it can be concluded that not all the dirtied air may have access to the target region 217 but can bypass the region close to the brushes. Close to the brushes the density of the droplets in the spray is relatively high which may compensate catching losses due to the bypass.

While the invention has been illustrated and described in detail in the drawings and foregoing description, such illustration and description are to be considered illustrative or exemplary and not restrictive; the invention is not limited to the disclosed embodiments.

For example, it is possible to operate the invention in an embodiment wherein the brush elements of the brush are another kind of fibre, hair, wire-shaped element or other kind of element.

It is also possible that the rotating axes of the brushes extend under an angle with the surface, like for example vertically. In this way the brushes can still produces the mist of droplets of fluid.

It is also possible to apply the cleansing liquid on the inside of both brushes. It is also possible to apply the cleansing liquid on the outside of the brushes by a spraying means comprising spray nozzles.

It is also possible that the coalesced particles 22 are moved only by means of the rotating brushes 3, 4 into the tube 12 and to a debris collecting chamber.

It is also possible that the cleaning device (1) comprises a collecting container for storing debris such as dirt, dust and fluid.

The work fluid may have cleansing properties but may also be a fluid which is unwanted such as spilled liquids; as long as the work fluid can be expelled as droplets that catch the dirt particles the advantages of the invention can be brought into practice. In that respect the work fluid may alternatively be indicated or referred to as catching fluid.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A cleaning device for removing particles from a surface, said cleaning device comprising:

a spraying apparatus including at least one rotatable brush for spraying droplets of a work fluid into a defined coalescing space within the cleaning device, said at least one rotatable brush having flexible brush elements arranged for wetting by a work fluid and being dimensioned such that, when said brush is rotated at a predetermined rotational speed, said brush elements expel said droplets of the work fluid into said coalescing space in the form of a mist;

an inlet disposed for receiving air-laden particles from the surface, said inlet being in communication with the defined coalescing space for, during operation, passing the air-laden particles into said defined coalescing space to be coalesced with the droplets of the mist; and a cleansing unit in communication with the defined coalescing space for, during operation, receiving and separating at least a portion of the coalesced particles from the air;

said operation including passing an air stream through the cleaning device for conveying the particles to the cleansing unit.

2. A cleaning device according to claim 1 where the flexible brush elements are dimensioned such that, when the at least one rotatable brush is rotated at said predetermined rotational speed, tips of the flexible brush elements have a minimum acceleration of one of at least 3000 m/sec$^2$ and at least 6000 m/sec$^2$.

3. A cleaning device according to claim 2 where said cleaning device is adapted to rotate the at least one rotatable brush at a minimum rotational speed of one of at least 3500 revolutions per minute, at least 7000 revolutions per minute, and at least 8000 revolutions per minute.

4. A cleaning device according to claim 2 where the flexible brush elements of the rotatable brush are arranged to run free from the surface to be cleaned and where said rotatable brush has a diameter of at least 40 mm.

5. A cleaning device according to claim 1 where at least a number of the flexible brush elements of the at least one rotatable brush are, during operation, in contact with the surface to be cleaned.

6. A cleaning device according to claim 1 comprising first and second rotatable brushes, each of said first and second rotatable brushes expelling, during operation, a mist of droplets in a direction toward a common target region of the defined coalescing space.

7. A cleaning device according to claim 6 where each of the first and second rotatable brushes has multiplicity of flexible brush elements that, during operation, are in contact with the surface to be cleaned, said first and second rotatable brushes being rotatable in opposite directions such that they rotate toward each other at the surface to be cleaned.

8. A cleaning device according to claim 1 where the rotatable brush has a diameter of at least 20 mm.

9. A cleaning device according to claim 1 and including:

at least one rotatable brush comprising a tube having a hollow core, said tube being provided with brush elements extending from an outer surface thereof and having at least one channel extending from inside of the hollow core to the brush elements;

a reservoir for storing work fluid; and a tubular member for conveying the work fluid from the reservoir to the hollow core.

10. A cleaning device according to claim 1 where the cleansing unit comprises a rotatable separator arranged for centrifugally separating at least a portion of the coalesced particles from the air during use.

11. A cleaning device according to claim 1 where an average distance between two adjacent ones of the flexible brush elements lies in one of the ranges 10-100 microns and 20-40 microns.

12. A cleaning device according to claim 1 where the flexible brush elements comprise polyester and have a Dtex-value lying in one of the ranges 0.01-50, 0.1-10, and 0.1-2.

13. A cleaning device according to claim 1 where the flexible brush elements comprise tufts arranged to provide a density of at least 30 tufts per $cm^2$.

14. A cleaning device according to claim 1 where the flexible brush elements have a Dtex-value lying in one of the ranges 0.01-50, 0.1-10, and 0.1-2.

15. A vacuum cleaner comprising a vacuum source and a cleaning device for removing particles from a surface, said cleaning device comprising:

a spraying apparatus including at least one rotatable brush for spraying droplets of a work fluid into a defined coalescing space within the cleaning device, said at least one rotatable brush having flexible brush elements arranged for wetting by a work fluid and being dimensioned such that, when said brush is rotated at a predetermined rotational speed, said brush elements expel said droplets of the work fluid into said coalescing space in the form of a mist;

an inlet disposed for receiving air-laden particles from the surface, said inlet being in communication with the defined coalescing space for, during operation, passing the air-laden panicles into the coalescing space to be coalesced with the droplets of the mist; and a cleansing unit in communication with the defined coalescing space for, during operation, receiving and separating at least a portion of the coalesced particles from the air;

said vacuum source, during operation, effecting passage of an air stream through the cleaning device for conveying the particles to the cleansing unit.

* * * * *